United States Patent [19]

Seidel et al.

[11] Patent Number: 5,067,914

[45] Date of Patent: Nov. 26, 1991

[54] MULTI-POLE CONNECTOR HAVING A CENTERING STRIP WITH A SHIELD

[75] Inventors: Peter Seidel, Groebenzell; Karl Zell, Niederpoecking, both of Fed. Rep. of Germany

[73] Assignee: Siemens Aktiengesellschaft, Munich, Fed. Rep. of Germany

[21] Appl. No.: 684,479

[22] Filed: Apr. 12, 1991

Related U.S. Application Data

[63] Continuation of Ser. No. 521,457, May 10, 1990, abandoned.

[30] Foreign Application Priority Data

Jun. 29, 1989 [DE] Fed. Rep. of Germany ..... 3921430

[51] Int. Cl.[5] ..... H01R 13/648

[52] U.S. Cl. ..... 439/609; 439/607; 439/686

[58] Field of Search ..... 439/374, 378, 380, 381, 439/607, 608, 609, 686

[56] References Cited

U.S. PATENT DOCUMENTS

| | | | |
|---|---|---|---|
| 3,559,813 | 2/1971 | Sosinski | 439/716 |
| 4,501,461 | 2/1985 | Anhalt | 439/607 |
| 4,597,618 | 7/1986 | Reimer | 439/374 |
| 4,601,527 | 7/1986 | Lemke | 439/608 |
| 4,712,849 | 12/1987 | Seidel et al. | 439/607 |
| 4,718,867 | 1/1988 | Seidel et al. | 439/609 |
| 4,738,637 | 4/1988 | Asick et al. | 439/609 |
| 4,808,115 | 2/1989 | Norton et al. | 439/609 |
| 4,812,137 | 3/1989 | Wilson et al. | 439/607 |
| 4,813,890 | 3/1989 | Zell et al. | 439/607 |

OTHER PUBLICATIONS

IBM Technical Disclosure Bulletin, "Straight-Through Connector", vol. 13, No. 11, pp. 3341 ∝ 3342, Apr. 1971.

*Primary Examiner*—Gary F. Paumen

*Attorney, Agent, or Firm*—Hill, Van Santen, Steadman & Simpson

[57] ABSTRACT

A multi-pole plug mechanism has a centering strip emplaceable onto a connection board for receiving a plug, the centering strip including a shield electrically connected to regions of the chassis holding the connection board and which are connected to ground. The shield is formed by a plurality of shield elements having shielding surfaces aligned parallel to the plug-in direction and that resiliently press against a shield of the plug in the plugged condition. The centering strip is composed of a bottom plate with passages therethrough for contact blades and comprises angular spacers per prescribed unit length in the respective corner regions that have seats for the contact blades in the free end regions. The shield comprises two metallic longitudinal spring strips and two metallic transverse spring strips including cooperating recesses and hook structures for mutual connection thereof and simultaneously form the entry region for plug sections as shielding per prescribed unit length.

2 Claims, 5 Drawing Sheets

MULTI-POLE CONNECTOR HAVING A CENTERING STRIP WITH A SHIELD

This is a continuation of application Ser. No. 521,457, filed May 10, 1990, now abandoned.

BACKGROUND OF THE INVENTION

Field of the Invention

The present invention relates to a multi-pole connector having a centering strip emplaceable on a circuitboard and serving for receiving a plug which has a shield that is electrically connected to regions of a chassis holding the circuitboard and that are connected to ground potential, whereby a shield is formed by separate shielding elements having shielding surfaces aligned parallel to the plug-in direction and that press resiliently against a shielding of the plug in the plugged-in condition of the plug.

Such a connector mechanism is disclosed, for example, the German Gebrauchsmuster 85 17 809. In this known plug mechanism, a transfer cable plug is connected to ground potential via sheet metal caps and via spring elements of a shielding element pressing against the outer surfaces of the centering strip. What is thereby disadvantageous is that the entire centering strip must be respectively shielded and that the width increases due to the utilization of shielding elements, so that certain rows of contact plates cannot be used given a circuitboard which is completely equipped with contact blades.

SUMMARY OF THE INVENTION

It is an object of the present invention to provide a connector of the type generally set forth above such that the established, admissible division remains preserved for the utilization of centering strips and to simultaneously improve the shield conductance compared to previously plug mechanisms and provide a more flexible shielding.

In a connector of the type generally set forth above, the above object is achieved, according to the present invention, in that the centering strip is composed of a bottom plate provided with passage openings for the contact blades, the bottom plate comprising angular spacers per prescribed length unit in the respective corner regions that have seats for the contact blades provided in a free end region of a contact blade, and in that, respectively, two metallic longitudinal spring strips and two metallic transverse spring strips having recesses or, respectively, hooks for mutual holding that simultaneously form an entry region for the plug units are provided as shielding per prescribed length unit.

In a plug mechanism constructed in accordance with the present invention, compared to the known plug mechanism, the center strip is produced without outside walls and partitions, so that only the floor and the spacers now remain. By omitting the walls, it becomes possible to utilize the space thereby arising for the spring strips both longitudinally as well as transversely between cable plugs without a division being thereby lost. In addition, the shielding can be flexibly undertaken in the plug mechanism constructed in accordance with the present invention, i.e. the centering strip need not be necessarily shielded over its entire length. It is possible to provide shielding only where such shielding is absolutely necessary. A further advantage of the plug mechanism of the present invention is that the shielding effect is noticeably increased since shields that are respectively transversely disposed are also provided.

According to a particular feature of the invention, the plug mechanism is particularly characterized in that the spring strips are composed of two sheets joined to one another, whereby the middle region of each sheet comprises spring tongues produced by punching out tongues that are angled off toward respective free ends. A good contacting to the shielding sheets of the cable plugs is thereby achieved. At the same time, an adequately-great stiffness for pressing the spring strips in is achieved by this structure.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
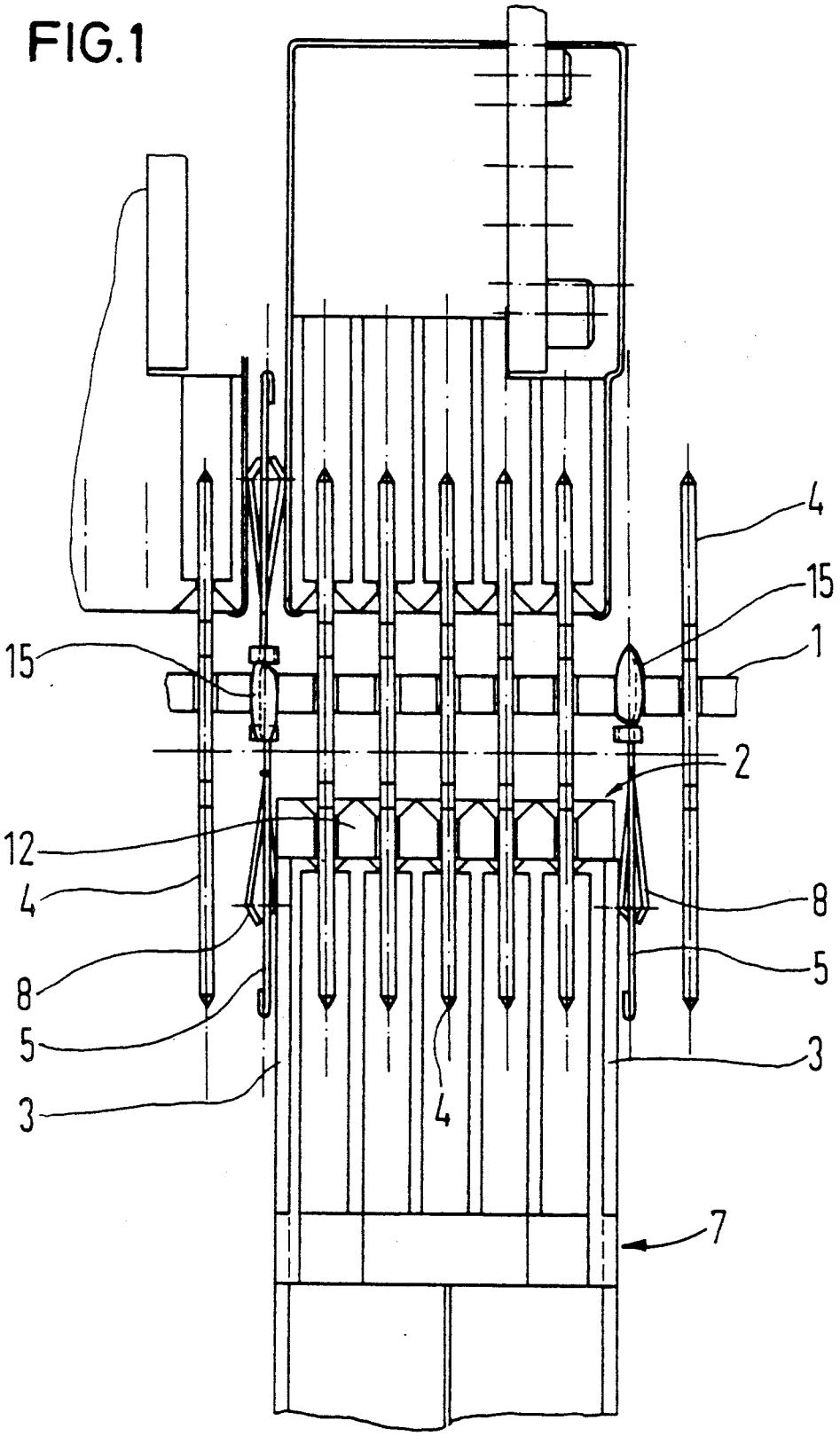
FIG. 1 is a sectional view taken through a multi-pole plug mechanism constructed in accordance with the present invention.
Figure 2:
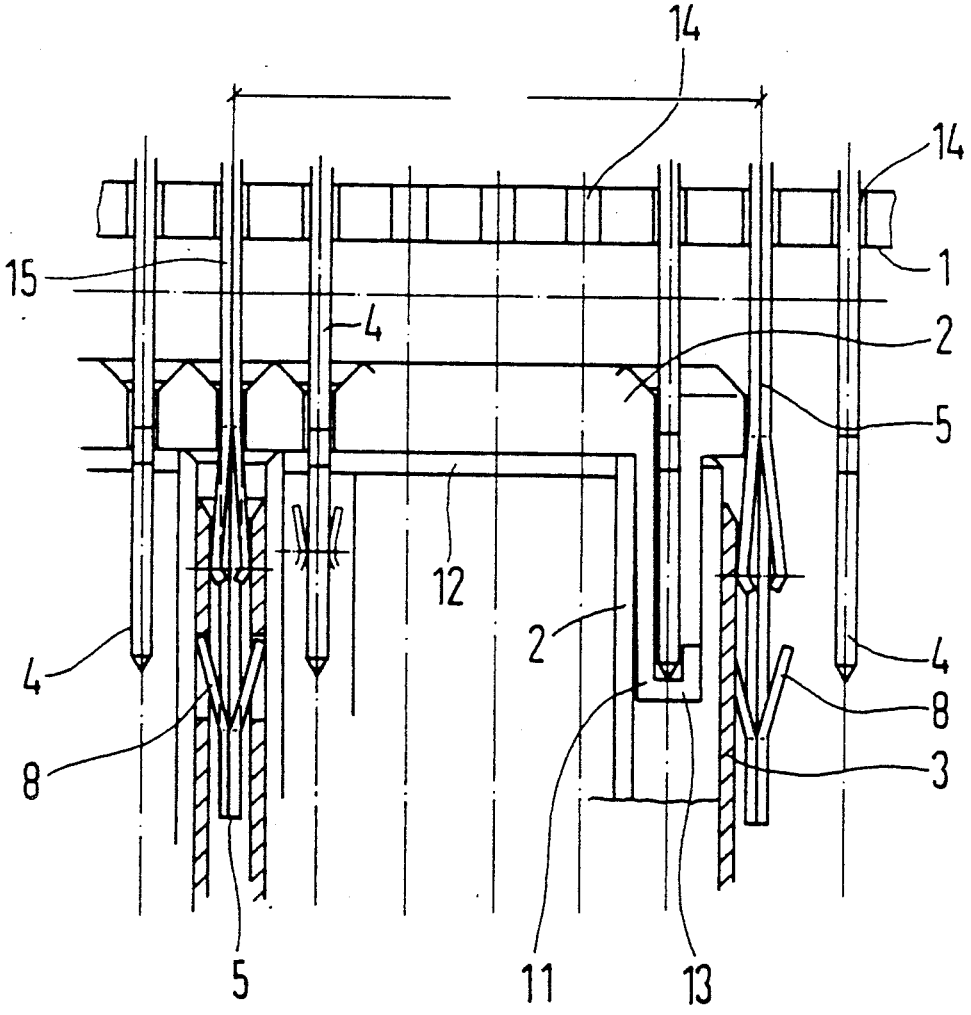
FIG. 2 is a detailed sectional view, shown enlarged, through the plug mechanism of the exemplary embodiment of FIG. 1.
Figure 3:
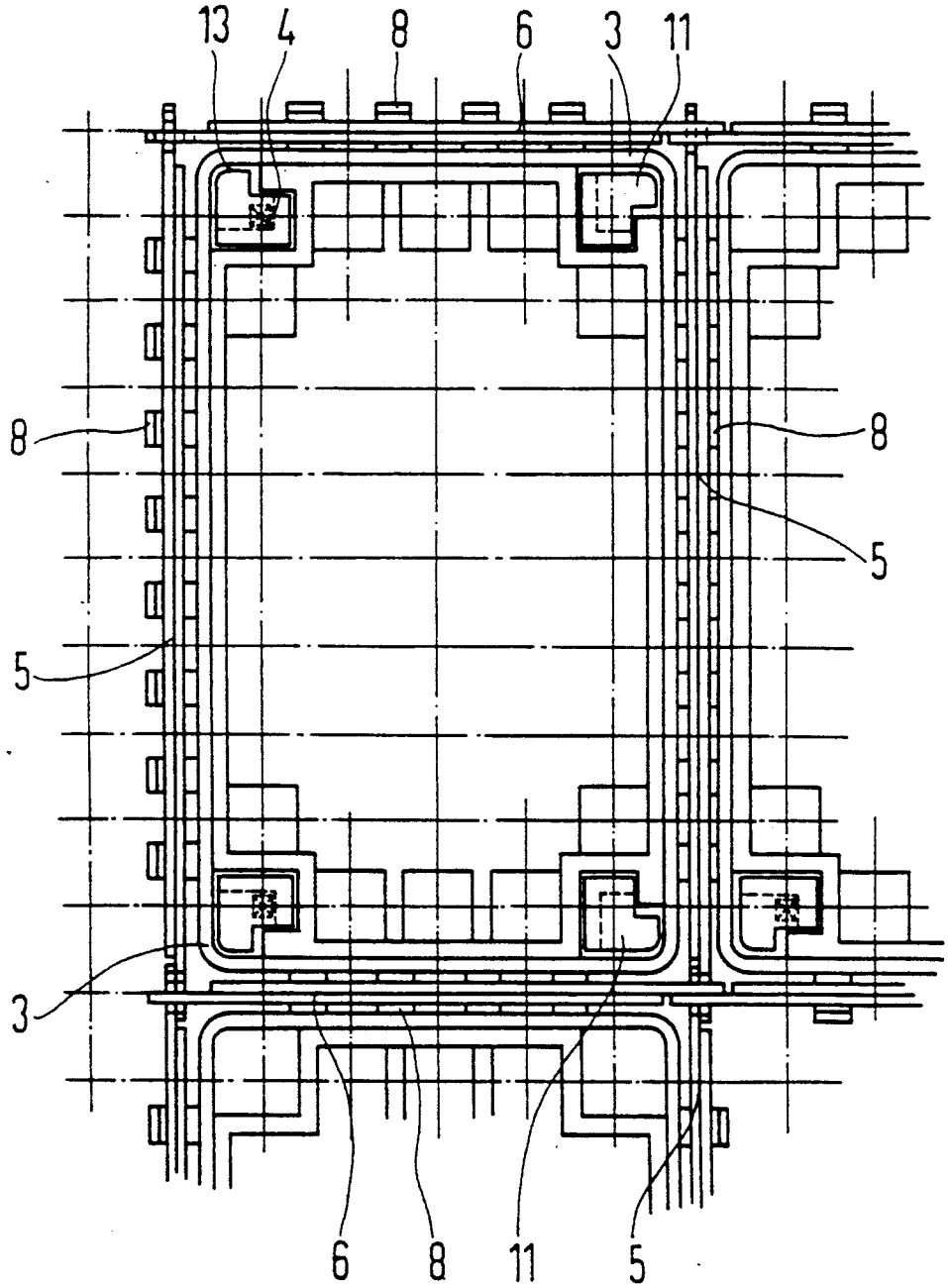
FIG. 3 is a plan view onto a prescribed sub-unit of the centering strip.

FIGS. 1 and 2 illustrate a section and an enlarged section, respectively, through a multi-pole plug mechanism constructed in accordance with the present invention. A plug cable 7 is plugged onto one side of a wiring backplane 1 in which the contact blades 4 are held as shown in FIG. 3 looking towards the wiring back plane 1, whereas an assembly is slipped onto the contact blades at the other side. When an appropriate shielding is desired, the metallic spring strips 5 and 6 are pressed into the openings for the contact blades with press-in projections 15.

Figure 6:
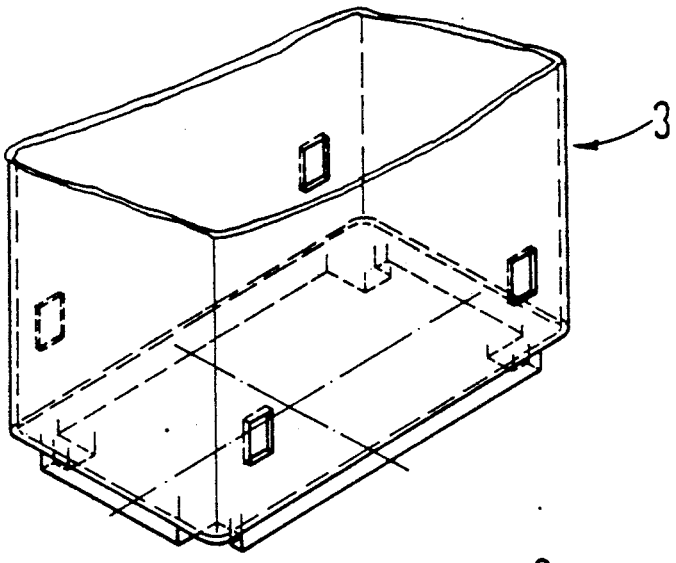
FIG. 6 is a perspective view of a cable plug shielding sheet without a housing.
Figure 4:
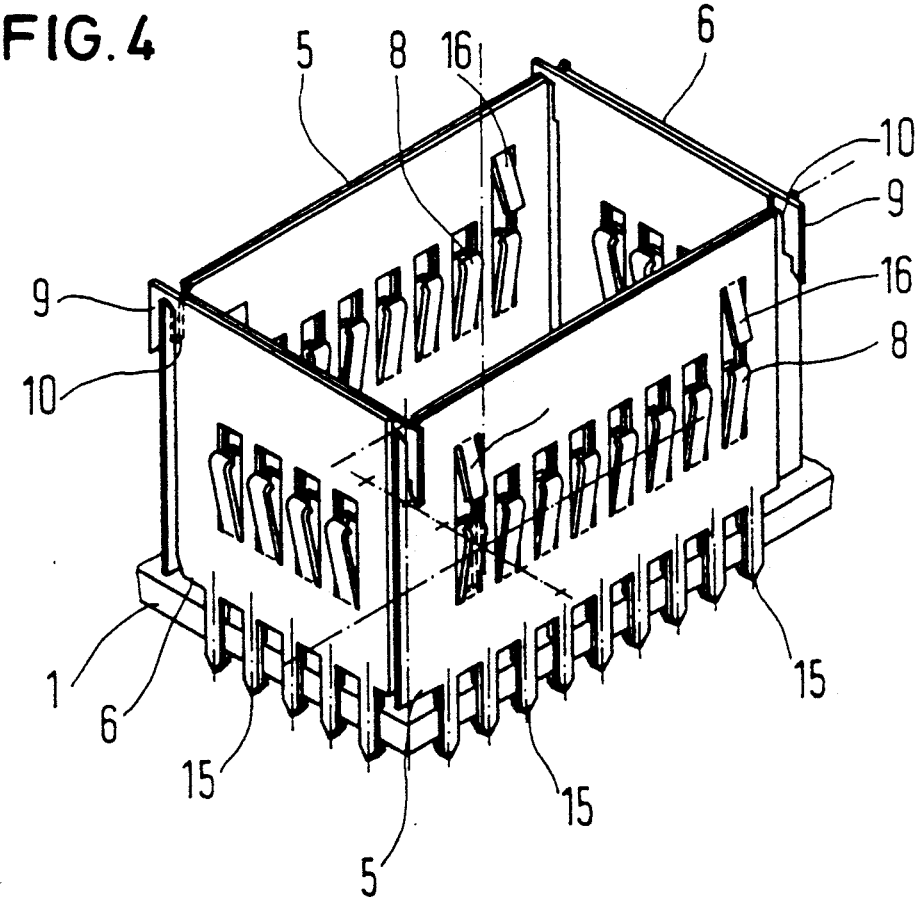
FIG. 4 is a perspective view of the spring strips for a sub-unit of the centering strips.

The structure of the metallic, longitudinal spring strips 5 as well as of the metallic, transverse spring strips 6 may be best seen in FIG. 4. The spring strips are composed of two metal sheets that, for example, are 0.3 mm thick, that are soldered in their final state or are spot welded in the final state. This achieves both an adequately-great stiffness for pressing-in and for the possibility of arranging the springs at both sides at the same location. The ends of the spring strips 5 and 6 have recesses 10 or, respectively, hooks 9 in which they mutually interconnect. Thus a modular structure is thereby guaranteed. It is no longer necessary to shield the entire centering strip; on the contrary, defined units can be designationally shielded. The entry opening for the cable sub-plugs 7 is formed by the two longitudinal spring strips and the two transverse spring strips so that a good connection is established between the metallic spring strips and the shielding sheet 3 (see FIG. 6) of the cable plug. The cable plugs 7 are secured from falling out with catch springs 16 that engage into corresponding recesses of the shielding sheet of the cable plug.

Figure 5:
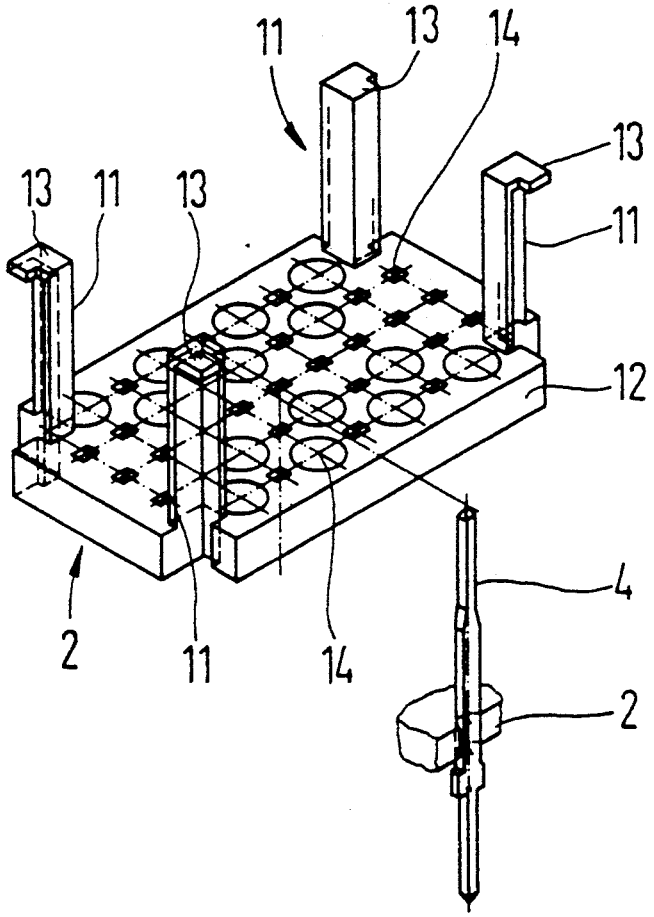
FIG. 5 is a perspective view of the structure of the centering strips for a sub-unit of a connector plug.

FIG. 5 illustrates the structure of the centering strip that is now composed only of the bottom plate 12 and of the spacers 11 in a plug mechanism constructed in accordance with the present invention. As a result thereof, the centering strip 2 has the seats 13 lying on the points of the contact blades 4, this guaranteeing a defined spacing from the connecting backplane 1. In addition, the centering strip 2 is held on the blades by rotatable disks (not shown here) in the bottom plate. A snap-in into the spring strips would, however, also be conceivable.

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. A multi-pole plug apparatus for plugging to a circuitboard which includes a plurality of spaced contact blades extending therefrom and a plurality of spaced aligned openings therethrough, comprising:

a rectangular plug section including a housing comprising a plurality of exterior housing walls, a rectangular centering plate connected to said housing walls and terminating said plug section, said centering plate including a plurality of openings therein each including a tapered entrance and defining a respective contact passage, a plurality of spacers carried by said centering plate and each aligned with a respective opening and including wall sections defining a spacer passage at an end wall terminating the spacer passage at an end opposite the respective opening, said passages receiving respective ones of said contact blades upon plugging, said contact blades contacting said end walls to limit plugging of said plug section and spacing said plug section a predetermined distance from the circuitboard;

a shield directly connected to, carried by and extending from the circuitboard, said shield including first and second longitudinal metallic spring strips and first and second transverse metallic spring strips each connected to said first and second longitudinal metallic spring strips to define a rectangular cavity for receiving and holding aid plug section.

said longitudinal metallic spring strips each comprising recesses adjacent their ends, said transverse metallic spring strips each comprising hook structures including complimental recesses and hooks at their ends, said recesses of said longitudinal and transverse metallic spring strips mating and said hooks of said transverse metallic spring strips overlapping said longitudinal metallic spring strips to connect said metallic spring strips together, and each of said metallic spring strips comprising two layers of sheet metal including a plurality of spring tongues punched out and extending at an angle therefrom to engage the respective exterior walls of said housing of said rectangular plug section, and each of said metallic spring strips comprising a plurality of projections each in the form of a cone, and each of said projections force fit into a respective one of said aligned openings.

2. The multi-pole plug apparatus of claim 1, and further comprising: a plurality of catch springs each punched and extending from said longitudinal metallic spring strips in a direction generally opposite to that of said spring tongues to engage the respective exterior walls of said housing of said rectangular plug section.

* * * * *